United States Patent [19]

Langan

[11] Patent Number: 4,852,194

[45] Date of Patent: Aug. 1, 1989

[54] SAFETY BARRIER FOR SMALL CHILDREN

[76] Inventor: Jeffrey M. Langan, 3413 Sunset, Boise, Id. 80376

[21] Appl. No.: 152,544

[22] Filed: Feb. 5, 1988

[51] Int. Cl.[4] ..... A47C 21/08

[52] U.S. Cl. ..... 5/427; 5/512; 256/24; 256/23

[58] Field of Search ..... 5/97, 427, 512, 93 R, 5/98 R, 99 A, 100; 160/135, 351, 354, 327; 256/23–26

[56] References Cited

U.S. PATENT DOCUMENTS

| | | | |
|---|---|---|---|
| 949,389 | 2/1910 | Almgren | 5/93 R |
| 1,344,588 | 6/1920 | Kozik | 5/512 |
| 2,696,620 | 12/1954 | LeRoy | 5/93 R X |
| 3,480,069 | 11/1969 | Handwerker | 160/354 |
| 3,537,688 | 11/1970 | Stein | 256/24 |
| 3,546,721 | 12/1970 | Cleary | 5/97 |
| 4,015,297 | 4/1977 | Christian | 5/97 |
| 4,359,792 | 11/1982 | Dale | 5/98 R X |

FOREIGN PATENT DOCUMENTS

| | | | |
|---|---|---|---|
| 160052 | 3/1921 | United Kingdom | 5/427 |

*Primary Examiner*—Gary L. Smith
*Assistant Examiner*—Michael F. Trettel
*Attorney, Agent, or Firm*—Charles S. McGuire

[57] ABSTRACT

A barrier or safety guard for preventing the escape of small children from a safe area, having as its basic element a panel of flexible material, preferably in the form of netting with relatively small apertures therein. A border of flexible material is provided for the periphery of the panel and has a plurality of spaced openings around the entire periphery of the panel. These openings are provided with grommets and a plurality of ties or laces by which the borders of the panel can be fastened to points on the supporting structure. The panel can be folded in either or both dimensions to adjust its size to smaller dimensions. Small sub-panels can be used to prevent the main panel from being dislodged.

4 Claims, 3 Drawing Sheets

SAFETY BARRIER FOR SMALL CHILDREN

BACKGROUND OF THE INVENTION

My invention relates to safety barriers for small children, and particularly to a safety barrier which is economical to manufacture, is readily portable, and adjustable in two dimensions, and can be applied without any special tools, and can be reused as desired.

Safety barriers specifically designed for use with children's furniture such as cribs and play pens are well known in the art. The prior art is directed to guards or barriers of fixed dimensions, designed to fit particular pieces of children's furniture. Many of these comprise rigid panels which are attached to the furniture by clamping devices. No simple means are provided to adjust the barrier to furniture or railings having different dimensions, so that the barrier can readily be applied to a large variety of supporting structures.

U.S. Pats. Nos. 633,353, 1,119,621, 2,607,931, 2,732,569, 3,044,078, 3,093,838 and 3,546,721 are exemplary of this prior art.

OBJECTS OF THE INVENTION

Accordingly, it is a principal object of my invention to provide an improved barrier providing a safety guard for infants and small children which is economical to manufacture, and easy to apply to a number of different situations.

Another object of the invention is to provide a barrier which can be adjusted or varied in two dimensions to adapt the barrier to different application situations.

Still another object of the invention is to provide a barrier which includes at least one sub-panel arranged to prevent the sliding or slipping of the barrier panel, and yet permit variations in the height of the barrier.

Yet another object of the invention is to provide a barrier which requires no special tools or devices to install the barrier.

SUMMARY OF THE INVENTION

The present invention provides a barrier for preventing the escape of small children from a safe area. The invention may be used to prevent a child from escaping from a closed area and is especially useful in preventing a child from trying to crawl through the space between the slats of a porch deck or stair railing, which could result in injury or death of the child.

A panel of suitable flexible material, such as canvas or plastic preferably in the form of netting with relatively small openings, for example on the order of one quarter of an inch, forms the basic element of the combination. A reinforcing border of flexible material is provided around the perimeter of the panel, this border being provided with a plurality of openings therethrough, spaced at predetermined intervals around the periphery of the panel. These border openings are reinforced with suitable grommets. To anchor the panel in place on the supporting structure a plurality of laces or ties are provided, which are threaded through the grommets and tied to convenient portions of the supporting structure, such as the upper and lower rails of a crib or porch railing, end posts, and the like. The laces can also be fastened to screw eyes or eyebolts in the floor.

Since the panels are flexible, they can be folded to lesser dimensons, without cutting or trimming. Also such adjustments can be made in both the width and the height of the panels. The laces will hold the folds in place.

An ancillary feature is the provision of small sub-panels of rigid or semi-rigid material such as plastic or thin wood, which are sewn or otherwise contained in the netting panel. These panels are located on the upper end corners of the panel and are of shorter dimensions than the height of the netting panel, thus not interfering with the rolling up of the netting panel. These sub-panels serve to keep the main panels from sliding or otherwise being dislodged from their proper position.

BRIEF DESCRIPTION OF THE DRAWINGS

The foregoing objects and other features of the invention and its advantages will become more fully understood from the following detailed description when considered with the accompanying drawings, in which.

DETAILED DESCRIPTION

Figure 1:
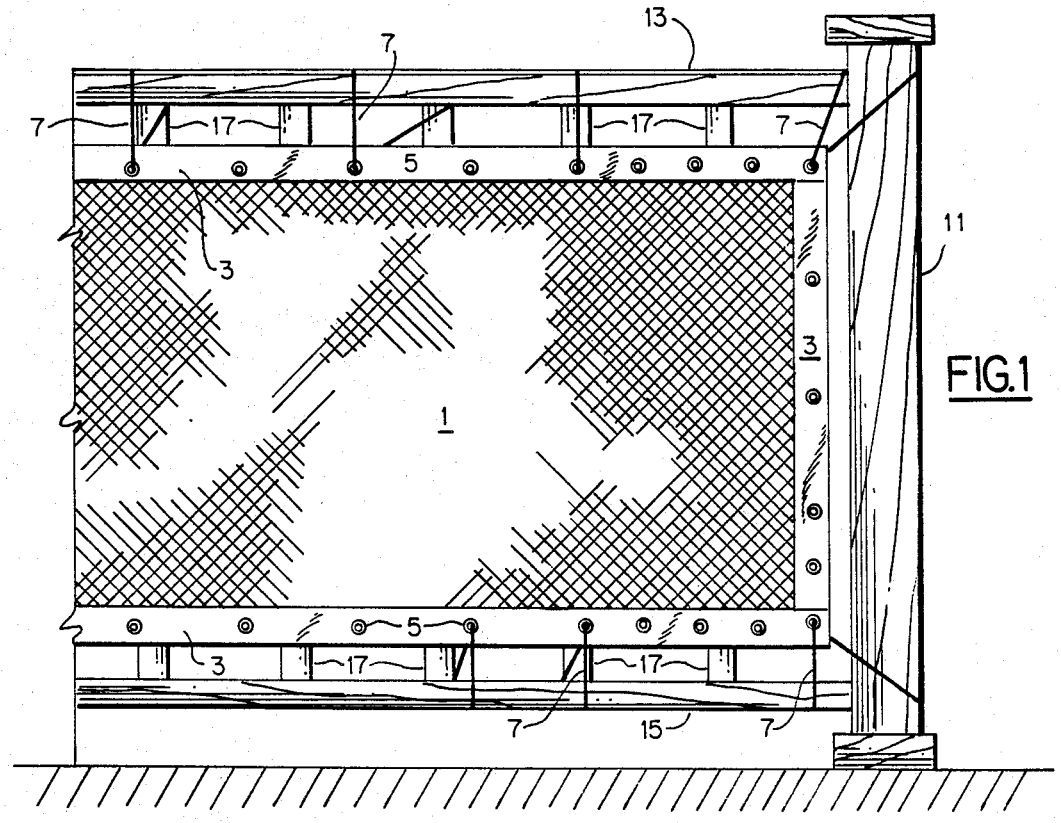
FIGS. 1 and 2 are fragmentary, elevational views of a barrier in accordance with a preferred embodiment of the invention.
Figure 2:
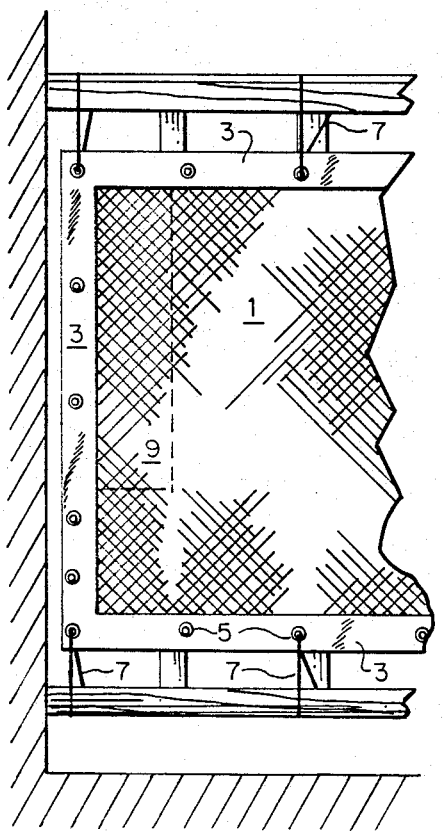

Referring now to the drawings, FIGS. 1 and 2, show the right and left sides, respectively, of the basic configuration of a barrier in accordance with a preferred embodiment of the invention. A panel 1, generally rectangular in shape, and of predetermined dimensions or multiples or sub-multiples of the basic dimensions, is provided, and is made of suitable flexible material, such as woven cloth, or plastic. The panel material may be in the form of netting, with relatively small openings or may be made of a solid sheet of the material. It may be transparent, translucent, or opaque, and can be of one color or multi-colored, and may have designs or patterns on either or both sides.

Preferably the panel material will comprise a net weave having $\frac{1}{4}$ to $\frac{1}{2}$ inch openings to permit the ready passage of fastenings therethrough, as will be subsequently described.

A border 3, of heavy duty canvas or like material is provided around the entire periphery of the panel, and is double lapped and double stitched, or otherwise securely affixed to the panel. This border is provided with openings having suitable grommets 5, spaced at regular and predetermined intervals around the perimeter of the panel. The grommets may be of metal or suitable non-metallic material, such as plastic.

To attach the panel to supporting members, a plurality of fastening devices, ties or laces 7, are provided, preferably one for each grommet and of a predetermined length, such as 18 inches, for example. The laces are passed through the associated grommet and looped around an adjacent supporting member, such as a portion of a railing with which the barrier is to be employed, as is apparent from the drawings. In the event that there is no supporting member available, for example, where there is no bottom rail present in a railing structure, the laces 7 may be attached to screw eyes or eyebolts 19 affixed to the floor, as apparent from the showings in FIGS. 3 and 4.

A novel and unique feature provided by this invention is a semi-rigid plate or sub-panel 9 which is sewn or otherwise affixed into an upper end corner of the panel 1. This plate or sub-panel may be on the order of four inches wide, and may be on the order of sixteen inches long. It can be a thin piece of metal, wood or plastic, and may be enclosed in heavy canvas or like material. The purpose of this plate of sub-panel is to keep the main panel from sliding or otherwise moving away from the end portion of the supporting structure, which would result in an escape hole or opening, thereby defeating the primary purpose of the barrier.

Figure 8:
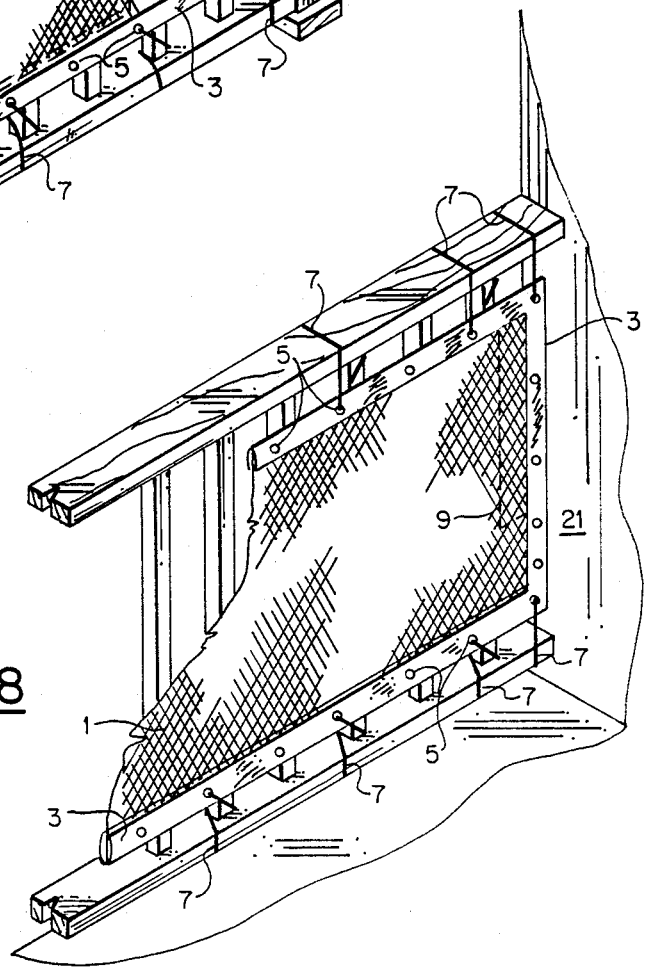
FIG. 8 is a fragmentary, perspective view showing the placement of a sub-panel in conjunction with the main panel.

As seen in FIG. 2 and FIG. 8, the plate is located in the upper portion of the end of the panel 1, this location permitting the lower portion of the panel 1 to be rolled up, in a manner and for purposes to be later described. The spacing of the grommets 5 permit the lacing of laces 7 in this vicinity to be such that the plate or sub-panel is securely held in the desired position. To the degree required, extra grommets are provided to permit appropriate alignment of extra laces to allow the rolling of the panel to adjust the length and width thereof to suit individual applications of the barrier.

Having thus generally described the features of the invention, it is now intended to describe the various features of adaptibility in greater detail, as shown in the various drawings.

FIG. 1 shows the manner in which a panel 1 is secured to a railing including an end post 11, an upper rail 13, and a lower rail 15, with a plurality of slats 17 extending between the upper and lower rails in well known fashion. The upper end corner of the panel border 3 is secured to the top of end post 11, as shown, and in similar fashion lace 7 secures the lower corner of the border to the lower portion of end post 11. Other laces 7 are fastened between the grommets 5 and the top and bottom rails as shown. The panel 1 is thus retained in position with no danger of its displacement to the point where its effectiveness as a barrier is impaired.

FIG. 2 illustrates the positioning of the plate or sub-panel 9 in the upper left hand portion of a panel 1. By positioning the panel in this manner, freedom is provided to roll up the panel from the bottom to allow for a shorter height of the railing, rather than the usual height, which is nominally about 36–42 inches. The nominal length of the panels can range from five to forty feet, and the width of the panel can range from 26 to 36 inches. The primary purpose of the sub-panel is to keep the entire unit from sliding away from the end wall, thus providing a possible escape opening.

Figure 3:
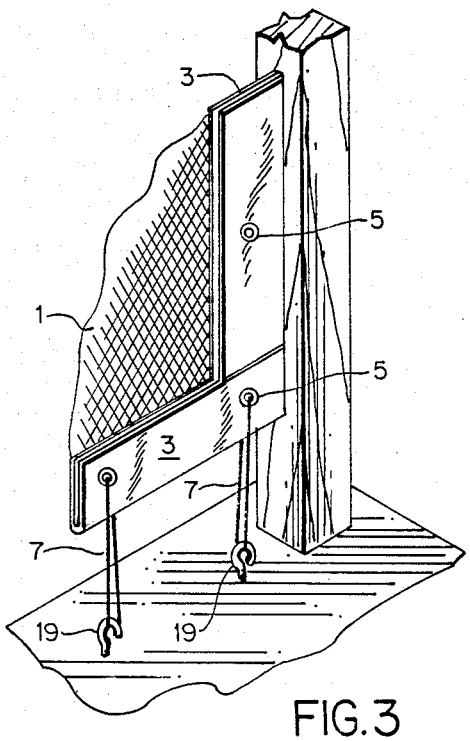
FIGS. 3 and 4 are fragmentary, perspective views showing the use of screw eyes for anchoring the lower border of the panel.

FIG. 3 is an enlarged view of a corner of a panel 1, and the associated border 3, showing the use of screw-eyes to anchor the laces 7. This construction is used in cases where a bottom rail is eliminated in the design of the railing or the bottom rail is not conveniently located, or is located too high from the floor, so as to present a possible hazzard. Obviously, other types of anchoring devices, such as eye-bolts, staples, etc., can be used to anchor the laces.

Figure 4:
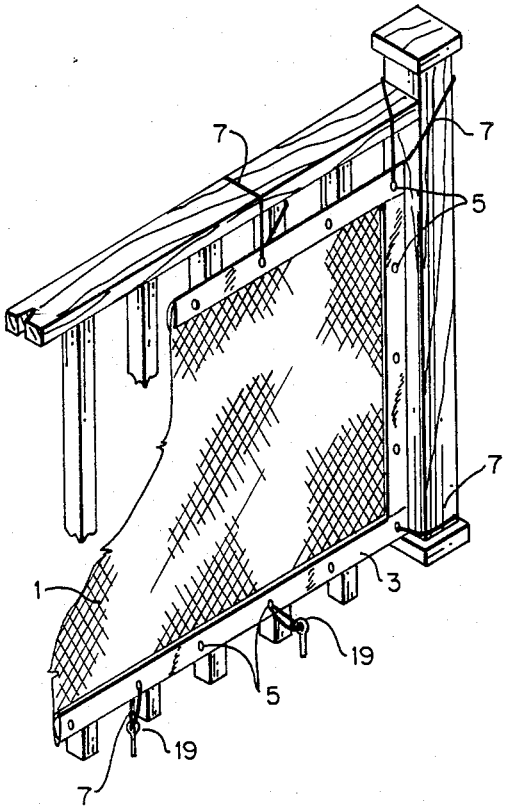

FIG. 4 also shows the use of screw eyes to anchor laces 7 in the case of a railing structure in which the bottom rail is omitted. Note the laces tying the panel to the top and the bottom of the railing end post.

Figure 5:
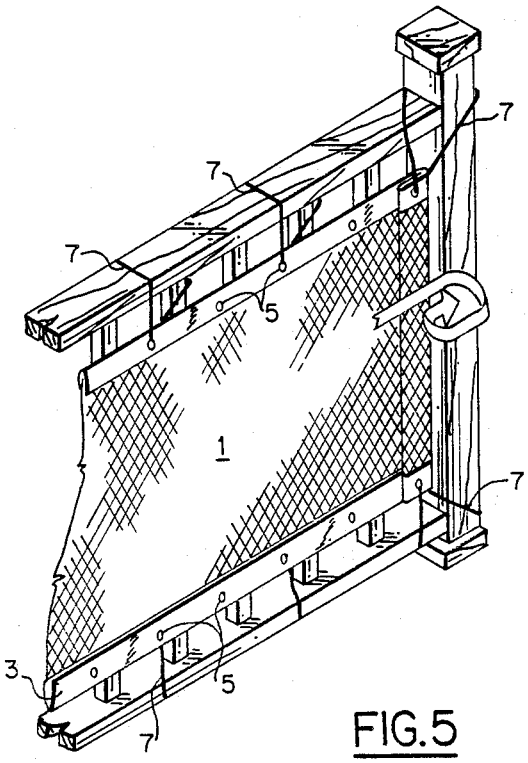
FIGS. 5, 6 and 7 are fragmentary, perspective views showing how the panel can be folded to make the effective dimensions of the panel smaller.

FIG. 5 is a view illustrating the manner in which a panel 1 may be foreshortened in the situation where the panel is of greater length than the railing with which it is associated. As shown, the panel is rolled upon itself starting at one end, such action being indicated by the looped broad arrow in the drawing. When shortened by the desired amount, laces 7 are used to fasten the rolled-up portion to the end post as shown, through the grommets 5. Additional laces 7 can be used at intermediate vertical points by threading the lace through the mesh openings in the panel. Thus, any excess length is neatly and unobtrusively stored, without cutting or trimming, and is preserved for possible future use.

Figure 6:
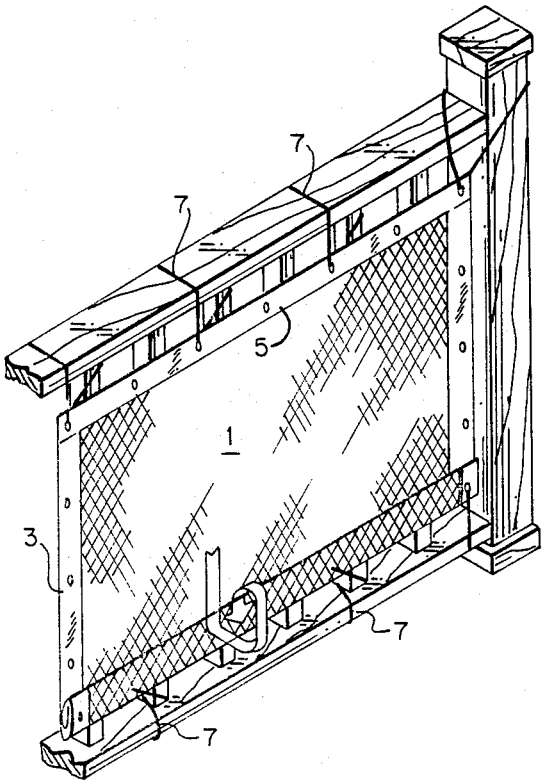

FIG. 6 is a view showing the manner in which a panel can be rolled up from the bottom to accommodate varying height requirements for various railing heights. As shown, the panel is rolled up upon itself, starting at the bottom border, as indicated by the looped broad arrow in the drawing. After rolling to the desired height, laces 7 are passed through the grommets and the intervening mesh openings in the panel material. As in the case of adjusting the length, this feature of the invention allows the excess width of the panel to be neatly and unobtrusively stored, without cutting or trimming, and the unused portion is thus saved for possible future use.

Figure 7:
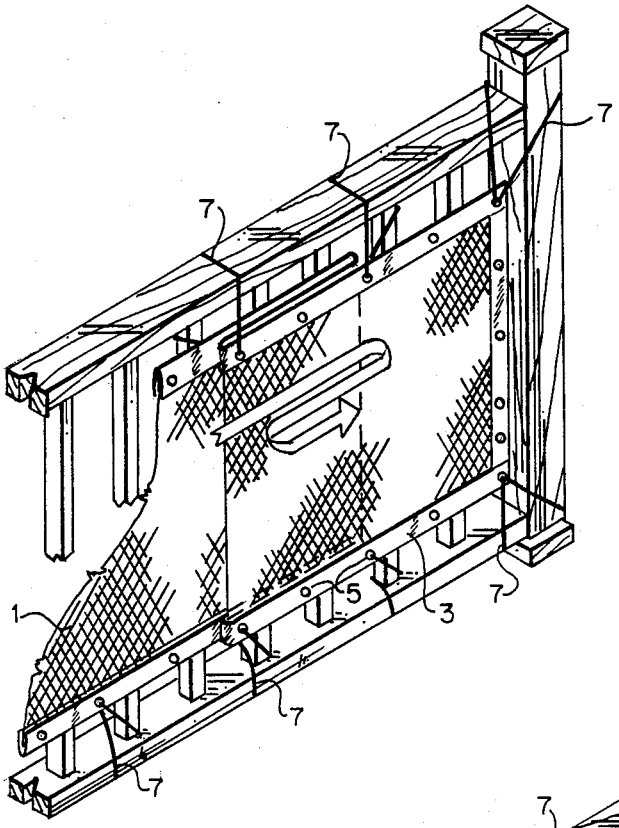

FIG. 7 shows an alternative manner of shortening the length of a panel, without cutting or trimming. In this instance, a portion of the panel is folded and lapped back upon itself as indicated by the looped broad arrow shown in the drawing. The portions are aligned so that the grommets line up to permit the threading of appropriate laces 7 therethrough.

Lastly, FIG. 8 shows the disposition of a panel 1 on a railing that abuts a wall or partition 21. The panel is placed so that the sub-panel 9, comprising a panel of substantially rigid material, such as wood or plastic, is located adjacent the wall 21. When positioned and retained by the laces 7, the sub-panel prevents any possible hazard created by pushing, pulling or sliding the panel 1 away from the wall. Since the sub-panel is located in the upper portion of the panel, it does not interfere with the rolling up of panel 1, as previously described, to permit variations in the height of panel 1.

From all of the foregoing, it is apparent that my invention provides a novel and useful improvement in the construction of barriers which act as safety guards to prevent young children from attempting to escape through railings, crib sides and the like, with the possibility of injury or death. The novel combination of a panel of flexible material, preferably a netting, with a reinforcing border and suitable fastening means for anchoring the panel in place, provides an arrangement which is adaptable for use with railings of different heights and widths, without cutting or trimming, and may be reused at will.

Although I have herein shown and described only several specific features and preferred embodiments of my invention, it will be apparent to those skilled in the art to which the invention appertains, that various other changes and modifications, may be made to the subject invention, without departing from the spirit and scope thereof, and therefore it is understood that all modifications, variations and equivalents within the spirit and scope of the subject invention are herein meant to be encompassed in the appended claims.

What is claimed is:

1. A wall construction comprising, in combination:

(a) a fence or railing construction including right and left end vertical support members, top and bottom horizontal support members, and a plurality of horizontally spaced, parallel rail members extending vertically between upper and lower ends anchored to said top and bottom horizontal support members, respectively;

(b) a substantially rectangular, flexible panel of netting material having relatively small apertures, said panel having a predetermined width and height at least substantially as great as the distances between said vertical and horizontal support members, respectively;

(c) a border of flexible reinforcing material secured to said panel to form marginal edge portions extending continuously along all four sides thereof;

(d) a plurality of openings, each surrounded by a reinforcing grommet, extending through said marginal edge portions, one of said openings being positioned adjacent each of the four corners of said marginal edge portions and a plurality of said openings being spaced at predetermined intervals along all four of said marginal edge portions in a straight line between said openings at said four corners; and (e) a plurality of laces extending through at least selected ones of said openings, said laces each being anchored to one of said members adjacent the opening through which they extend to support said panel in covering relation to said fence or rail construction, the number and spacing of said openings along all of said marginal edge portions being such that said panel and border may be folded upon themselves in both the width and the height directions and said laces passed through said openings in folded portions of said border and anchored to said support structure, whereby the effective width and height of said panel and border may be selectively reduced to conform to fence or railing constructions wherein the width and/or height are less than said predetermined width and/or height, respectively, said panel thus providing a safety barrier preventing small children from passing partially or entirely through the spaces between said rail members.

2. The wall construction of claim 1 and further including a stiff sub-panel affixed to said panel in superposed relation thereto adjacent at least one, upper corner thereof, said sub-panel having a width a small fraction of the width of said panel, whereby said sub-panel provides support for said panel at said upper corner to effectively prevent displacement of said panel at said upper corner.

3. The wall construction of claim 1 wherein one of said vertical support members comprises a wall and the other comprises a post.

4. The wall construction of claim 1 wherein said bottom horizontal support member comprises a floor and said top horizontal support member comprises an upper rail.

* * * * *